United States Patent [19]

Peschke et al.

[11] 4,330,909

[45] May 25, 1982

[54] APPARATUS FOR FLATTENING AND GUIDING AN ELONGATED WEB

[75] Inventors: Jürgen Peschke, Meitingen; Franz Mair, Augsburg; Ludwig Zerle, Mering, all of Fed. Rep. of Germany

[73] Assignee: Erhardt & Leimer KG, Augsburg, Fed. Rep. of Germany

[21] Appl. No.: 169,144

[22] Filed: Jul. 15, 1980

[30] Foreign Application Priority Data

Jul. 16, 1979 [DE] Fed. Rep. of Germany ..... 2928641

[51] Int. Cl.[3] ..... D06C 3/06

[52] U.S. Cl. ..... 26/75; 26/105; 226/2 D

[58] Field of Search ..... 26/75, 105; 226/18, 226/19, 20, 21

[56] References Cited

U.S. PATENT DOCUMENTS

| | | | |
|---|---|---|---|
| 7764 | 11/1850 | Butcher | 26/105 |
| 879,298 | 2/1908 | Muller | 26/105 X |
| 3,740,805 | 6/1973 | Catallo | 26/105 X |
| 4,224,724 | 9/1980 | Bassani et al. | 26/75 |

FOREIGN PATENT DOCUMENTS 1039468 9/1958 Fed. Rep. of Germany .

*Primary Examiner*—Robert Mackey
*Attorney, Agent, or Firm*—Karl F. Ross

[57] ABSTRACT

An elongated knit web is flattened and guided by an apparatus having a support frame which extends longitudinally in a plane and which has an upstream and a downstream end. A pivot supports this frame for pivoting about a pivot axis transverse to the plane at the upstream end. A pair of transversely extending and longitudinally spaced spreader rollers are provided on the frame adjacent the upstream end and each has a pair of screwthread formations of opposite hand, these spreader rollers being driven to spread out the web transversely. A pair of transversely extending and longitudinally spaced guide rollers are provided on the frame between the spreader rollers and the downstream end, these guide rollers being freely rotating and having surfaces which are made to adhere to the web to prevent its edges from curling up. A control system pivots the frame about its pivot axis to position the edges of the exiting web.

14 Claims, 5 Drawing Figures

DRIVE
16
17
35
18
M
5A
36
M
13
6A
12
21
CONTROLLER
10A
11
7
14
α
2
3
8
5
1
4
6
13
37
SUCTION
12
9A
9
10

APPARATUS FOR FLATTENING AND GUIDING AN ELONGATED WEB

FIELD OF THE INVENTION

The present invention relates to an apparatus for flattening an elongated textile web. More particularly, this invention concerns an apparatus for flattening out or uncurling a knit web formed by slitting a knit tube.

BACKGROUND OF THE INVENTION

In the production of knitted goods the original knit product is normally a tube that is detwisted as described in copending application 134,268 filed Mar. 26, 1980 and is then longitudinally slit. It is then necessary to flatten out this slit tube in order that it can be dyed, treated with size or simply rolled up on a core.

Flattening out the slit tube is complicated considerably by the tendency of its edges to curl up. Accordingly, it is necessary to provide special devices which flatten out the slit tube to its proper width and which prevent its edges from curling back. This is normally achieved by passing the slit tube sinusoidally over a pair of so-called spreader rollers, each of which is subdivided at its center into a pair of screwthread formations of opposite hand. These rollers are rotated at a peripheral speed greater than the feed rate of the textile over them so that the screwthread formations exert an outward force on the web which holds it relatively flat.

Such a system has the disadvantage that the workpiece invariably wanders transverse to its feed direction back and forth on the spreader rollers. Equipment must be provided downstream of these rollers to properly position it in a direction transverse to the feed direction. The trouble with this arrangement is that if the goods are left unsupported for any distance the edges curl up again, making it extremely difficult to guide and center the web. This centering or guiding apparatus, even at its best, takes a relatively long portion of the feed path for the knit web.

OBJECTS OF THE INVENTION

It is therefore an object of the present invention to provide an improved apparatus for flattening and guiding an elongated textile web.

Another object is to provide such an apparatus which is relatively simple and which is relatively short compared to the prior-art systems.

SUMMARY OF THE INVENTION

This object is attained according to the instant invention by mounting a pair of transversely extending and longitudinally spaced spreader rollers adjacent the upstream end of a frame and a pair of transversely extending and longitudinally spaced guide rollers on this frame between the spreader rollers and its downstream end. The frame extends longitudinally from its upstream to its downstream end in a plane normally including the axes of these rollers, and is itself pivoted at its upstream end about a pivot axis transverse to this plane. The textile web is fed sinusoidally over these rollers from the upstream end to the downstream end and drive means is connected to the spreader rollers for rotating them relative to the web and thereby flattening the web.

According to this invention, the surfaces of the guide rollers are provided with means for increasing the adhesion between these surfaces and the web. This means can be a sticky or brush-type surface, or the guide rollers can be provided with a suction device which aspirates air at the surfaces and holds the web tightly in contact therewith. Thus, immediately downstream of the spreader rollers, the textile web engages the guide rollers, thereby ensuring that the edges do not curl up again. Passing sinusoidally back and forth over these guide rollers decreases the tendency of the web to curl up considerably. Furthermore, the longitudinal tension in the web is effective on the pivotal frame to keep it centered and keep the web centered at the downstream end of the frame for feeding of the web into a subsequent treatment stage.

It is also possible, according to this invention, to provide stationary sensor means downstream of the frame for detecting the position of the edge of the web and generating a signal corresponding thereto and special drive means connected to the sensor means for receiving the signal and to the frame for displacing the frame when the edge moves at the sensor means from a predetermined position. Thus, a feedback arrangement is provided which ensures proper twisting of the frame about its pivot axis so that the web at the downstream end is always positioned properly.

With this type of construction, it is therefore possible to flatten out the web effectively in a relatively short distance along the treatment path. At the same time, the web can be positioned so that it can be fed directly into a subsequent treatment stage with great accuracy with respect to its positioning transverse to the displacement direction.

According to further features of this invention, it is possible to provide a third spreader roller which not only increases the contact area between spreader rollers and the web, but which can be set up to be positioned in any of several locations to either side of the plane of the apparatus. Thus, regardless of the direction of curl of the edges of the fabric it is possible for a single apparatus to appropriately flatten the web and feed it out with good accuracy. Counter-rotating the last spreader roller will further enhance the spreading effect to ensure that the workpiece is perfectly flat when it contacts the first guide roller. The adjustable spreader is set up so that it engages the outside of the goods, that is the side away from which the edges curl, while the other two spreader rollers engage the inside of the goods for most effective spreading of the web.

Due to the enhanced adhesion between the surfaces of the guide rollers and the knit web being treated in the apparatus according to this invention, it is possible for these guide rollers to be freerunning, that is to rotate freely about their axes. As a result, the apparatus is relatively simple according to this invention. These guide rollers are spaced relatively closely behind the spreader rollers. In fact, according to this invention, the spacing in the plane between the rollers is normally not greater than their diameters. The possibility of curling up of the edges of the web is therefore largely eliminated.

According to further features of this invention, the frame is supported via slide feet approximately midway between its upstream and downstream ends on a curved track having a center of curvature at the pivot axis. This pivot axis is relatively close to the upstream end, however, so that in fact lines drawn between this pivot axis and the outer ends of the closest roller form an obtuse angle. Such a system effectively supports the entire frame and all of its rollers while allowing considerable twisting for compensation of even the most badly twisted incoming web.

In accordance with yet another feature of this invention, an upstream sensor is provided for detecting the deviation of the frame angularly about its axis from a predetermined median position and by generating a signal which varies positively for deviation in one angular direction and negatively for deviation in the other angular direction, this signal being proportional to the extent of deviation. The downstream sensor is stationary and is provided immediately downstream of the last guide roller and similarly generates a positive signal when the edge of the web moves in one direction from a predetermined position and negatively in the opposite position with, once again, the signal being proportional to the extent of deviation. This downstream sensor is provided immediately downstream of the last guide roller so that it reacts immediately when the web edge moves from the desired position. The two signals are combined or added together so as to prevent hunting of the control arrangement for positioning of the arrangement so that the exiting web lies exactly at the desired position. Combining these two signals prevents the frame being excessively displaced in a compensatory direction in the event that the web edge deviates greatly from the desired position, but instead insures a gentle but accurate return to the desired position.

SPECIFIC DESCRIPTION

Figure 1:
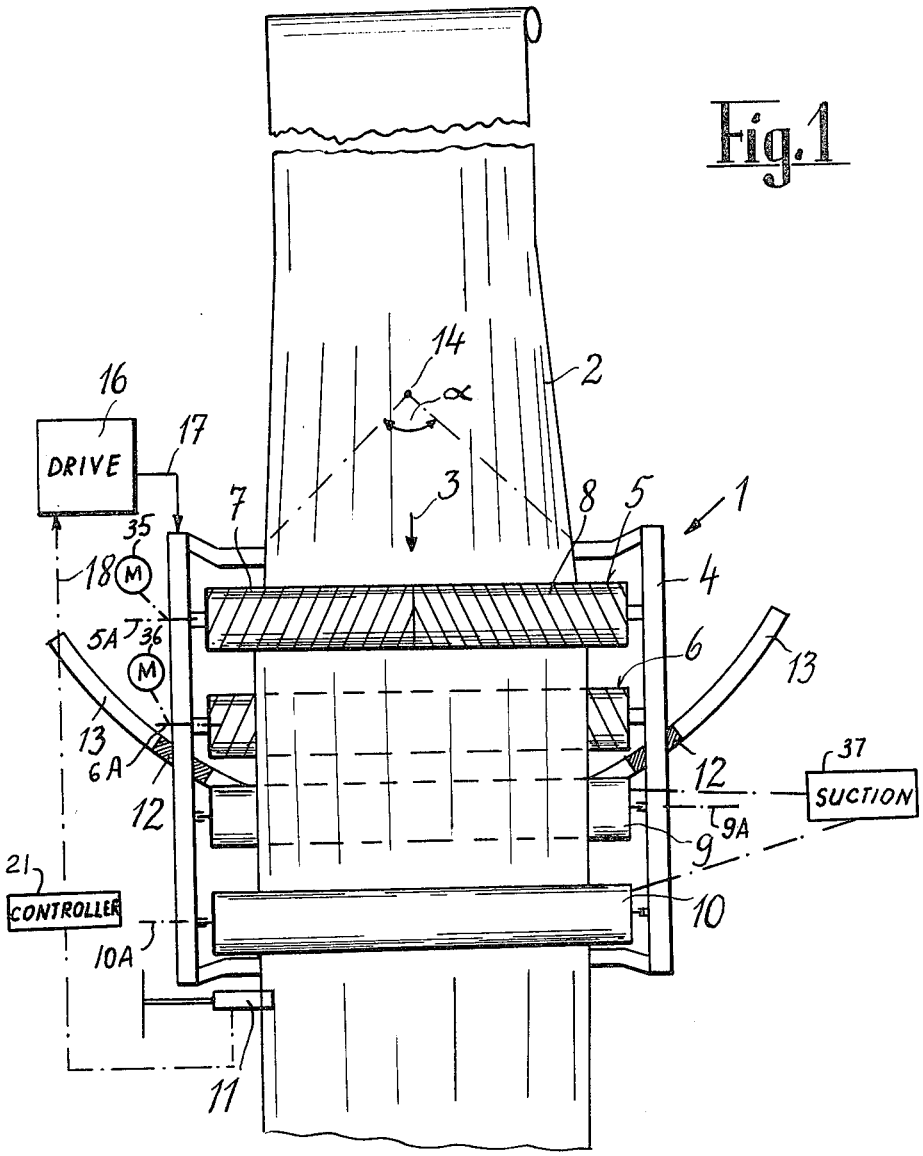
FIG. 1 is a top view of a system according to the instant invention.
Figure 2:
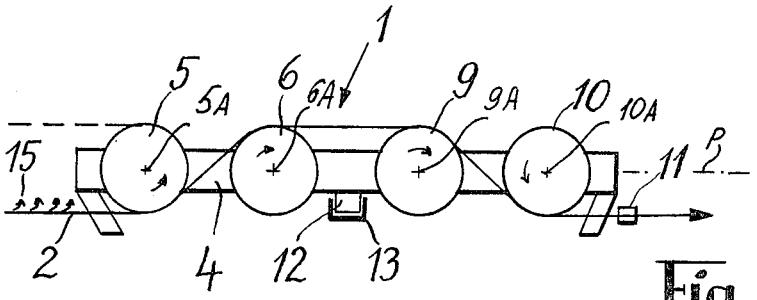
FIGS. 2 and 3 are side views of other systems according to this invention.

As shown in FIGS. 1 and 2, an apparatus 1 according to the instant invention serves for flattening out and guiding a textile web 2 fed in a direction 3 at a normally constant rate. This web 2 is a slit knit tube whose edges have a tendency to curl up as indicated at 15 at FIG. 2.

According to this invention, a frame 4 extends generally in a plane P and is pivotal at its upstream end about an axis 14 extending vertically and perpendicularly to the plane P. The frame 4 carries a pair of identical spreader rollers 5 and 6 centered on respective roller axes 5A and 6A and driven by respective motors 35 and 36 for rotation at peripheral speeds greater than the feed speed of the web 3. Each of the rollers 5 and 6, whose axes 5A and 6A lie in the plane P, is subdivided at its center into a pair of screwthread formations 7 and 8 of opposite hand. The direction of rotation of these rollers 5 and 6 is such that they exert an outward force in the plane P perpendicular to the direction 3 to flatten out the web 2.

Provided immediately downstream of the rollers 5 and 6 on the frame 4 is a pair of guide rollers 9 and 10 of substantially identical diameter and having axes 9A and 10A lying in the plane P and parallel to the axes of the rollers 5 and 6. The surfaces of these rollers 9 and 10 are made to adhere to the web 2 by aspirating air through them via a suction device 37, the rollers 9 and 10 being hollow and having many holes on their surfaces.

The frame 4 is supported by means of a pair of slide feet 12 on an arcuate track 13 whose center of curvature lies at the axis 14. This axis 14 is spaced relatively closely upstream of the frame 4, in fact so close that the angle $\alpha$ formed by lines drawn from it to the outer ends of the upstream spreader roller 5 is greater than 90°.

Provided immediately downstream of the frame 4 is a downstream sensor 11 which may be of the photoelectric type and which is connected to a drive 16 through a controller 21 by an appropriate electrical connection indicated schematically at dot-dash line 18. This drive 16 is connected as indicated schematically at 17 to the frame 4 and can displace this frame 4 about the axis 14. In fact the drive 16 can incorporate a motor carrying a gear that rotates about an axis parallel to the plane P and passing perpendicularly through the axis 14 and that meshes with an arcuate rack parallel to the track 13 but fixed on the frame 4.

Figure 3:
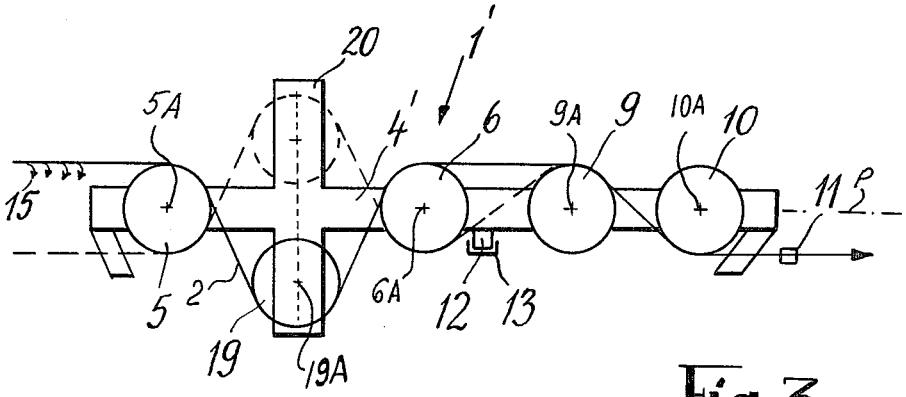

It is also possible as shown in FIG. 3 for an apparatus 1' having a frame 4' to be provided with a third spreader roller 19 lying between the rollers 5 and 6 and having an axis 19A parallel to the axes 5A and 6A. This roller 19 is carried on an adjustable support 20 so that it can be mounted on either side of the plane P or at any of a multiplicity of spacings therefrom. Thus if the fabric curls, as indicated at 15 in FIG. 3, it is fed along the solid line and the roller 19 is in the solid-line position. If the web 2 curls oppositely it is fed along the dashed line and the roller 19 is in the dashed-line position, this roller 19 therefore always engaging the outside of the goods so that the inside of the goods is engaged by both of the rollers 5 and 6 for maximum spreading effect.

Figure 4:
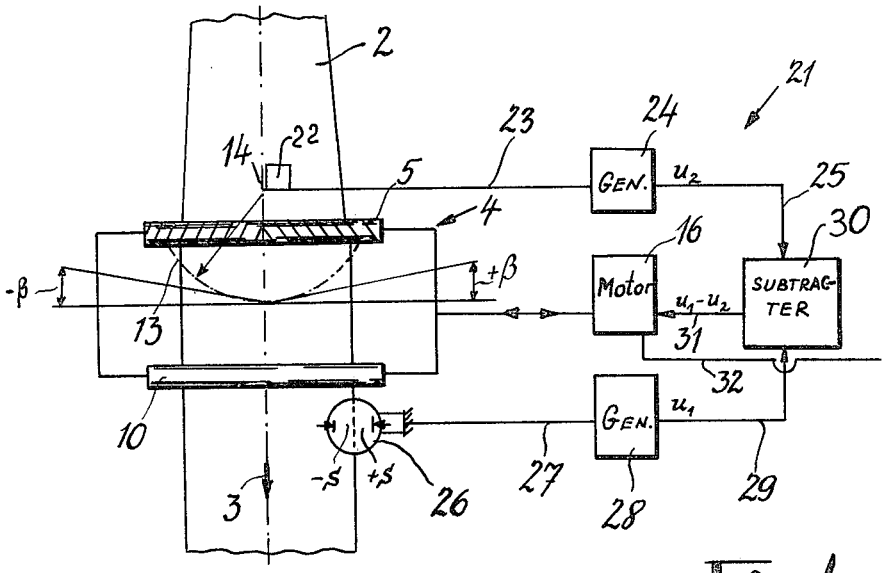
FIG. 4 is a largely schematic view illustrating operation of the system according to this invention.

FIG. 4 shows in more detail the controller 21. A sensor 22 is provided at pivot 14 for detecting the deflection of the frame 4 from a central position, as indicated by the angles $-\beta$ and $+\beta$. This signal is fed via line 23 to a generator 24 that produces an output signals $u_2$ and varies below a certain level in proportion to the size of $-\beta$ and above that level in proportion to $+\beta$. This signal $u_2$ is fed via line 25 to an arithmetic unit or subtractor 30. The sensor 11 is embodied as a photocell 26 which deflects the deviation of the edge of the goods 2 from a desired position as indicated by $-s$ and $+s$. In fact the beam of light directed at the photocell 26 will have a light value increasing proportionately above a certain level as $+s$ and decrease below this level as $+s$ decreases. This signal is fed via line 27 to another generator 26 which produces an output voltage $u_1$ fed via line 29 to the unit 30. In this unit 30 the signal $u_2$ is subtracted from the signal $u_1$ and fed via line 31 to the motor 16. Another manual override input 32 is provided.

Figure 5:
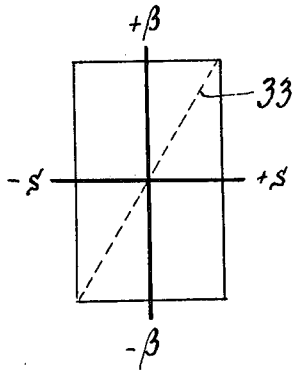
FIG. 5 is a graph illustrating operation of the control system of FIG. 4.

As seen in FIG. 5, the output signal from the unit 30 will follow the line 33 depending on the levels of its input signal. Assuming that the frame 4 lies in the central position exactly perpendicular to the direction 3 and the web edge lies in the desired position, the signals $u_1$ and $u_2$ will be exactly equal and no error signal will be fed to the motor 16. Assuming that the web edge starts to move so that the signal $u_1$ decreases, with the signal $u_2$ remaining the same, the motor 16 will receive a signal which will pivot the frame counterclockwise as seen in FIG. 4, thereby automatically decreasing the signal $u_2$. The decreasing signal $u_2$ will cancel out the decreased signal $u_1$ to prevent the system from overshooting the position necessary to overcome the error, and will in fact ensure that the frame 4 will move gently into the position necessary to properly position the edges of the web 2 without hunting or overshooting. In other words, the correction signal is canceled out even before the web edge has moved back into the desired position so that the controller 21 automatically compensates for the inertia of the frame 4 and web 2.

Nonetheless it has proven very effective to correct the error signal fed to the motor 16 by the actual position of the frame, rather than guiding it solely by the deviation of the edge of the web from its desired position. The described system gives an extremely sensitive and accurate controlling of the web 2.

We claim:

1. An apparatus for flattening an elongated textile web, said apparatus comprising:

a support frame extending generally longitudinally in a plane and having an upstream end and a downstream end;

means supporting said frame for pivoting about a pivot axis transverse to said plane at said upstream end;

a pair of transversely extending and longitudinally spaced spreader rollers on said frame adjacent said upstream end and each having a pair of screwthread formations of opposite hand;

a pair of transversely extending and longitudinally spaced guide rollers on said frame between said spreader rollers and said downstream end;

feed means for passing said textile web sinusoidally over said rollers from said upstream end to said downstream end at a transport speed;

means connected to said spreader rollers for rotating same relative to said web at a peripheral speed greater than said transport speed and thereby flattening said web on said spreader rollers; and automatic control means for detecting the position of said web and for automatically angularly displacing said frame about said pivot axis to align said web with a predetermined edge position when said web deviates therefrom.

2. The apparatus defined in claim 1 wherein said control means comprises:

stationary downstream sensor means downstream of said frame for detecting the position of the edge of said web and generating a signal corresponding thereto; and drive means connected to said sensor means for receiving said signal and to said frame for displacing same when said edge moves at said sensor means from said predetermined edge position in a displacement direction bringing said edge back into said predetermined edge position.

3. The apparatus defined in claim 2, further comprising:

upstream sensor means connected to said frame for detecting the angular pivotal deviation therefrom in said plane from a predetermined median position and for generating a signal corresponding thereto; and modulating means between both of said sensor means and said drive means for receiving and combining both of said signals and for operating said drive means in accordance with the combined signals.

4. The apparatus defined in claim 3 wherein said signal of said downstream sensor means is proportional to the deviation of said web from said predetermined edge position and said signal of said upstream sensor means is proportional to the deviation of said frame from said predetermined median position, said modulating means subtracting said signal from said upstream sensor means from said signal from said downstream sensor means to produce a difference signal that is fed to said drive means to angular displace said frame to an extent proportional to said difference signal.

5. The apparatus defined in claim 1, further comprising a stationary support track substantially parallel to said plane and curved about a center at said axis, and slide feet on said frame riding on said track.

6. The apparatus defined in claim 1, further comprising a third such spreader roller between said pair of spreader rollers and offset from said plane.

7. The apparatus defined in claim 6, further comprising means for mounting said third spreader roller at any of a plurality of locations vertically offset from said plane.

8. The apparatus defined in claim 6, further comprising means for mounting said third spreader roller at any of a plurality of locations vertically offset to either side of said plane.

9. The apparatus defined in claim 1 wherein said guide rollers have respective axes generally in said plane and are freely rotatable thereabout.

10. The apparatus defined in claim 1 wherein said guide rollers have surfaces provided with means for increasing the adhesion between said surfaces and said web.

11. The apparatus defined in claim 1 wherein said rollers are all of generally the same diameter and are spaced apart in said plane by distances smaller than said diameter

12. The apparatus defined in claim 1 wherein said pivot axis is upstream of all of said rollers.

13. The apparatus defined in claim 12 wherein the angle formed between lines extending from said pivot axis to the end of the closest roller is obtuse.

14. The apparatus defined in claim 1 wherein said pivot axis is upright and said plane is horizontal.

* * * * *